US005113220A

United States Patent [19]

Kwak

[11] Patent Number: 5,113,220

[45] Date of Patent: May 12, 1992

[54] DRUM CARTRIDGE FOR ELECTROPHOTOGRAPHIC APPARATUS WITH TWO-PIECE PROTECTED SHUTTER COVERING THE DRUM

[75] Inventor: Jin-keun Kwak, Suwon, Rep. of Korea

[73] Assignee: Samsung Electronics Co., Ltd., Rep. of Korea

[21] Appl. No.: 642,220

[22] Filed: Jan. 15, 1991

[30] Foreign Application Priority Data

Sep. 29, 1990 [KR] Rep. of Korea ..... 90-15368

[51] Int. Cl.[5] ..... G03G 15/00

[52] U.S. Cl. ..... 355/200; 355/211

[58] Field of Search ..... 355/210, 211, 212, 213, 355/71, 260, 200

[56] References Cited

U.S. PATENT DOCUMENTS

| | | | |
|---|---|---|---|
| 4,462,677 | 7/1984 | Onoda | 355/210 |
| 4,540,268 | 9/1985 | Toyono et al. | 355/210 |
| 4,575,221 | 3/1986 | Onoda et al. | 355/211 X |
| 4,708,455 | 11/1987 | Kubota et al. | 355/211 |
| 4,829,334 | 5/1989 | Takamatsu et al. | 355/211 X |
| 4,908,668 | 3/1990 | Takamatsu et al. | 355/274 |
| 5,061,959 | 10/1991 | Kinoshita | 355/210 |

FOREIGN PATENT DOCUMENTS

| | | | |
|---|---|---|---|
| 0139566 | 6/1987 | Japan | 355/211 |
| 0191861 | 8/1989 | Japan | 355/211 |

*Primary Examiner*—A. T. Grimley
*Assistant Examiner*—Christopher Horgan
*Attorney, Agent, or Firm*—Leydig, Voit & Mayer

[57] ABSTRACT

A drum cartridge with a protective cover for an electrophotographic apparatus is disclosed.

The protective cover consisting of an upper and a lower covers separately formed from each other, and the upper cover is operable to be opened and closed by a first gear pivoting around a drum shaft of a photosensitive drum. The lower cover is operable to be opened and closed by a connecting rod coupled to a second gear in mesh with the first gear, and has a driving pin driven by external force.

According to the construction, the protective cover is automatically opened and closed by mounting and separating the drum cartridge, and capable of making the exposed area of a photosensitive drum be wide in open position and perfectly protecting the photosensitive drum in closed position.

8 Claims, 3 Drawing Sheets

DRUM CARTRIDGE FOR ELECTROPHOTOGRAPHIC APPARATUS WITH TWO-PIECE PROTECTED SHUTTER COVERING THE DRUM

FIELD OF THE INVENTION

The present invention relates to a drum cartridge for an electrophotographic apparatus, and particularly to a drum cartridge with an improved protective cover for an electrophotographic apparatus.

BACKGROUND OF THE INVENTION

A photosensitive drum is generally adopted as an image bearing member in an electrophotographic apparatus which is widely utilized as a dry-type photocopier or a laser printer. The surface of the photosensitive drum is charged, e.g., by corona charger, and an original or the information of a computer output are recorded thereon as an electrostatic latent image by means of light source such as laser beam or the like. The electrostatic latent image is developed into a toner image by a developer using a toner or the like, the toner image, in turn, transferred onto a transfer medium such as a paper sheet by a transfer discharger. After the toner image is fixed into a visible image by a fixing device, the transfer medium is discharged to the outside of the apparatus. Then, the photosensitive drum is ready for forming the next image, after any toner remaining thereon is removed by a cleaner.

In such an electrophotographic apparatus, frequent disassembling of the apparatus or interchanging of the components are inevitably required for the supply of developer such as a toner or the like, discard of the waste toner, cleaning of the discharger, maintenance, or check-up. Moreover, when a so-called jam occurs by inadequate feeding of a transfer medium, it becomes necessary to open the apparatus often to remove the jammed transfer medium.

According to the above, the image formation means are constructed by a kit of a unitary structure in recent years, thereby bringing about convenience in maintenance and checkup. The general process kit comprises a photosensitive drum, a developer, a charger, and a cleaner in a casing which is commonly referred to as a drum cartridge.

A photosensitive layer such as that of a zinc oxide or an organic semiconductor are formed on the photosensitive drum, and this photosensitive layer is liable to be deteriorated by being exposed to severe external light, and to be injured or stained by touching with a hand or a tool. The deterioration, stain, or injury of the photosensitive drum results in lowering the quality of the transfer image.

Therefore, U.S. Pat. No. 4,462,677, No. 4,470,689 or the like, for example, disclose an image formation apparatus having a process unit, or a drum cartridge with a protective cover operable to be opened and closed. When the drum cartridge is mounted to the apparatus, the protective cover is opened, conversely, when the drum cartridge is pulled out from the apparatus, the protect cover is closed for protecting the photosensitive drum.

In the U.S. Pat. No. 4,470,677, however, a user opens and closes the protective cover from the outside of the apparatus by a linear slide mechanism, thus causes mechanical difficulties in fabrication or in use.

Meanwhile, in the U.S. Pat. No. 4,462,677, the protective cover is operable to be opened and closed by a link mechanism driven by the elasticity of a spring and a projection formed thereto. However, since the protective cover of this invention is opened in only one direction, the exposed area of the photosensitive drum becomes reduced. Accordingly, it is disadvantageous in that the transfer device should be installed within a narrow area and that it limits the transfer speed.

SUMMARY OF THE INVENTION

It is an object of the present invention to provide a drum cartridge with a protective cover for an electrophotographic apparatus which can be automatically opened and closed according to the mounting of the drum cartridge.

It is another object of the present invention to provide a drum cartridge with a protective cover for an electrophotographic apparatus ensuring reliable opening and closing of the protective cover without imposing unfavorable force upon the mechanism.

It is still other object of the present invention to provide a drum cartridge with a protective cover for an electrophotographic apparatus capable of making the exposed area of a photosensitive drum be wide in the open position and completely protecting the photosensitive drum in the closed position.

To achieve these and other objects, the drum cartridge with a protective cover for an electrophotographic apparatus including a photosensitive drum rotatably supported by support brackets formed on both sides of a main body, and a part of the drum being exposed through an opening of the main body; and a protective cover for selectively opening and closing the opening comprising;

an upper cover for covering a part of the opening and rotatably supported by a drum shaft of the photosensitive drum; a lower cover for covering the remaining part of the opening; a first connecting rod, one end of which is hingedly coupled to one side of the lower cover; a first gear rotatably supported to the a drum shaft, and operable for opening and closing the upper cover; a second gear engaged with the first gear and having a driving pin for accepting a predetermined torque transmitted from outside, and a portion of the second gear coupled to other end of the first connecting rod; and a second connecting rod, one end of which hingedly coupled to the support bracket, and other end of which hingedly coupled with the other side of the lower cover.

BRIEF DESCRIPTION OF THE DRAWINGS

Other object and advantages of the present invention will become more apparent by the following description with reference to accompanying drawings, in which.

DETAILED DESCRIPTION OF THE INVENTION

Figure 1:
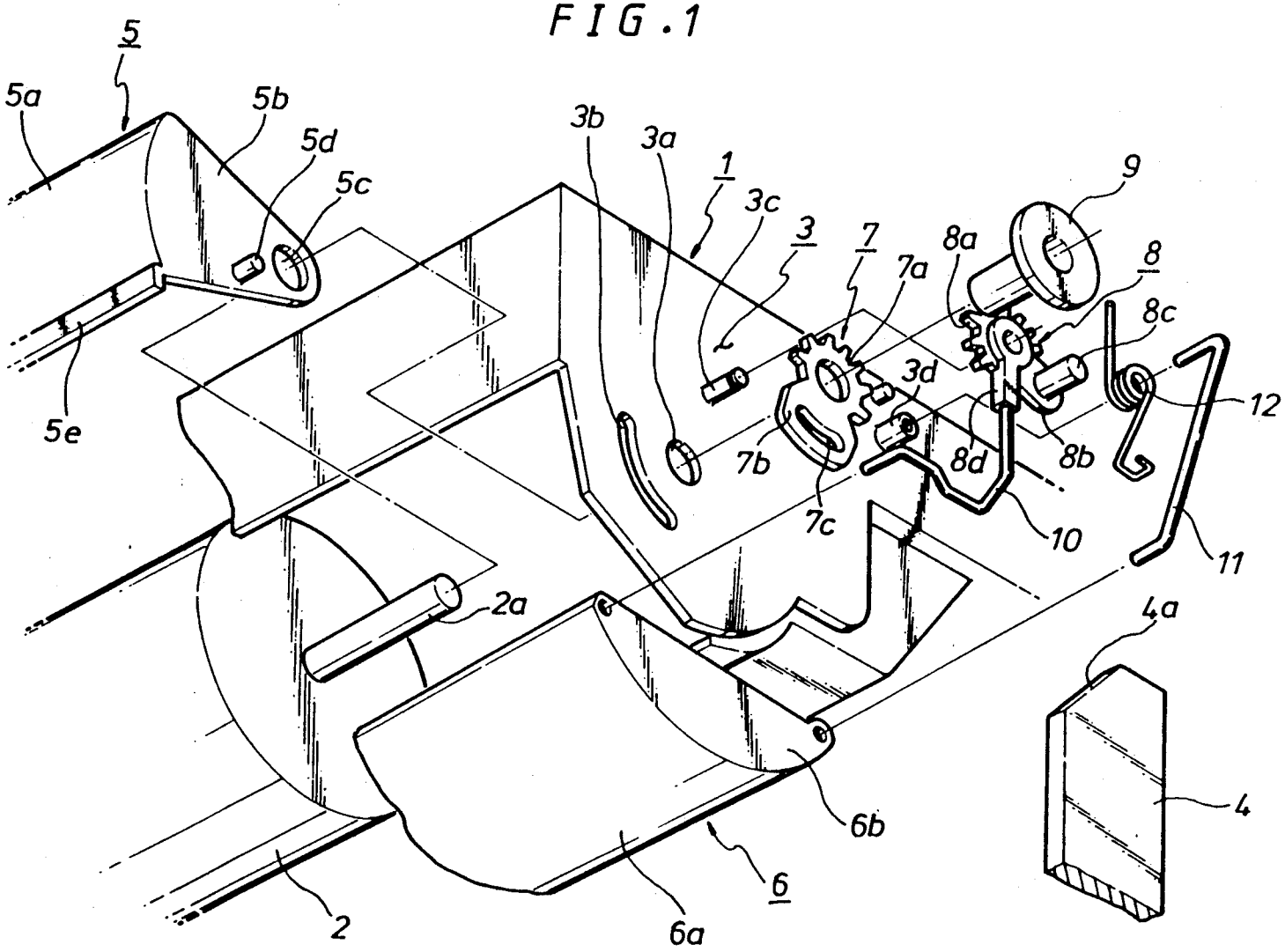
FIG. 1 is a partial exploded perspective view showing a drum cartridge according to the present invention.

In FIG. 1, an opening and a space are formed in a main body 1, and a photosensitive drum 2 is inserted into the space through the opening. The shaft 2*a* of the photosensitive drum 2 is rotatably supported by brackets 3 formed on both sides of the main body 1. The drum shaft 2*a* is outwardly projected at a predetermined length through hole 3*a* formed in the support bracket 3.

A protective cover is formed by two parts of an upper cover 5 and a lower cover 6. The upper cover 5 has significantly arc shaped section, and includes front wall 5*a* extending in the transverse direction of the main body, and two side walls 5*b* significantly in the shape of a fan extending from both edges of the front wall 5*a*. Support holes 5*c* for being rotatably supported by the drum shaft 2*a* are formed in both side walls 5*b*, and a driven pin 5*d* is projected on at least one side wall 5*b*.

On the other hand, the lower cover 6 is formed with a front wall 6*a* having significantly arc shaped section and side walls 6*b* at both sides thereof, and hinge holes pivotally coupled to first and second connecting rods 10 and 11, which will be described later, are formed in both ends of the side walls 6*b*. It is preferable to form an overlap abutment 5*e* along one end of the upper cover 5 or the lower cover 6 for enhancing the protective effect by covering the opposing edge when the protective cover is closed.

A first gear 7 is rotatably supported by a portion of the drum shaft 2*a* outwardly projected from the main body 1. A bearing member or an end cap 9, or, an unillustrated E-ring are successively coupled to the external side of the first gear 7 for preventing separation. A gear portion 7*a* is formed along the outer circumference of the first gear 7, and an extension 7*b* having a circular arc-shaped guide cam 7*c* is formed at a portion of the outer circumference thereof. The guide cam 7*c* is formed for accepting and guiding the driven pin 5*d* of the upper cover 5 through a circular arc-shaped guiding cam 3*b* formed in the support bracket 3.

Meanwhile, a hinge pin 3*c* is projected on the upper portion of the through hole 3*a* in the support bracket 3, so that the second gear 8 is rotatably supported by the hinge pin 3*c*. The second gear 8 has a gear portion 8*a* to be engaged with the first gear 7, a lever 8*b* with a driving pin 8*c*, and an extension 8*d* to be coupled with the first connecting rod 10, which will be described later. While the drum cartridge is inserted, the driving pin 8*c* formed on the lever 8*b* of the second gear 8 is guided by a guide plane 4*a* of a protrusive piece 4 positioned at the side portion of the drum cartridge, and drives the second gear 8, for example.

The other end of the first connecting rod 10 of which one end is coupled into the extension 8*d* of the second gear 8 is hingedly fitted into the front hinge hole in the side wall of the lower cover 6. Here, the first connecting rod 10 is preferably bent, e.g., to be an L-shape in order to keep away from the interference with the first gear 7.

On the other hand, a hinge boss 3*d* is formed at the rear position of the hinge pin 3*c* on the support bracket 3, thereby hingedly fitting one end of the second connecting rod 11 thereinto. A torsion spring 12 for elastically biasing the second connecting rod 11 to the closing position of the protective cover is also fitted into the hinge boss 3*d*.

The protective cover and the device for opening and closing thereof are constructed by commonly connecting the aforesaid members. It will be sufficient that the device for opening and closing the protective cover is formed only at one side of the drum cartridge, and a rotation support device of the lower cover, e.g., the second connecting rod is provided at the other side of the drum cartridge.

Referring to FIGS. 2 to 4C, the operation of the above mentioned drum cartridge will be described in detail.

Figure 2:
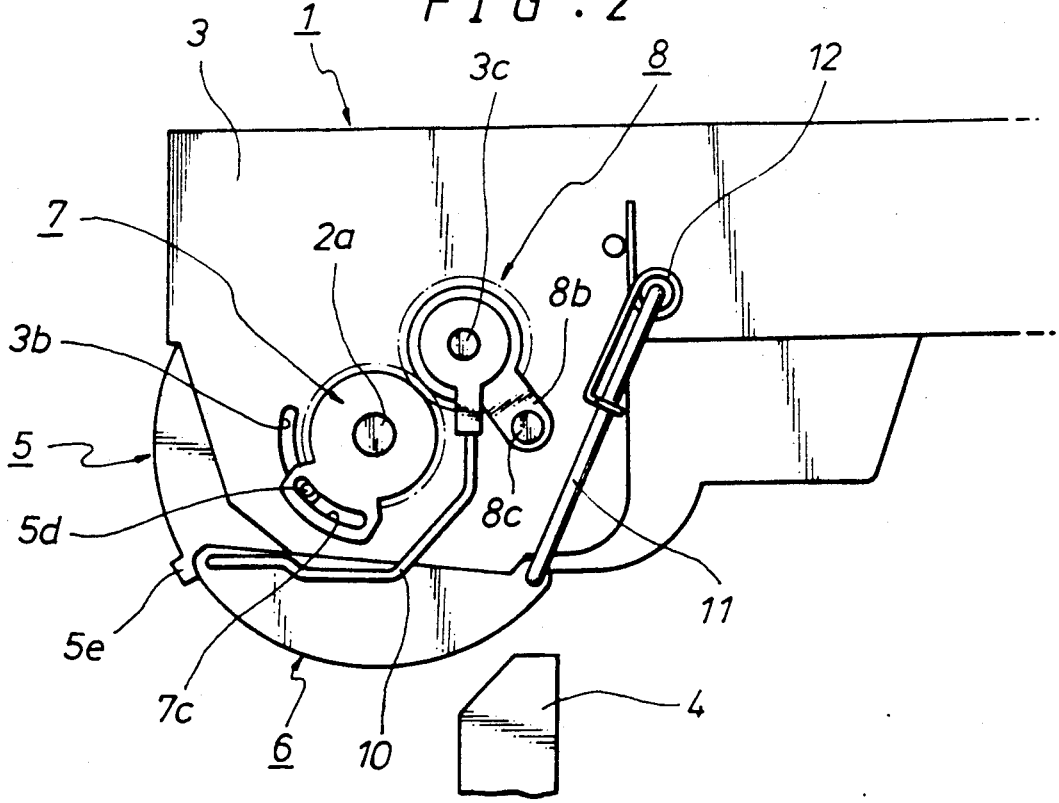
FIG. 2 is a partial side view showing the drum cartridge of FIG. 1 with the protective cover in the closed position.

In FIG. 2, the drum cartridge is in position that the protective cover is closed, that is, the drum cartridge is pulled out from the electrophotographic apparatus. Under this condition, the second connecting rod 11 is clockwise biased for closing the lower cover 6 by the torsion spring 12, and, followed by this operation, the second gear 8 is clockwise biased to close the upper cover 5. Here, the overlap abutment 5*e* of the upper cover 5 covers the edge of the lower cover 6, thereby completely blocking the light emitted from the outside into the photosensitive drum, which is not illustrated in FIG. 2. Since the protrusive piece 4 is separated from the driving pin 8*c*, any interaction is not produced between them.

Figure 3:
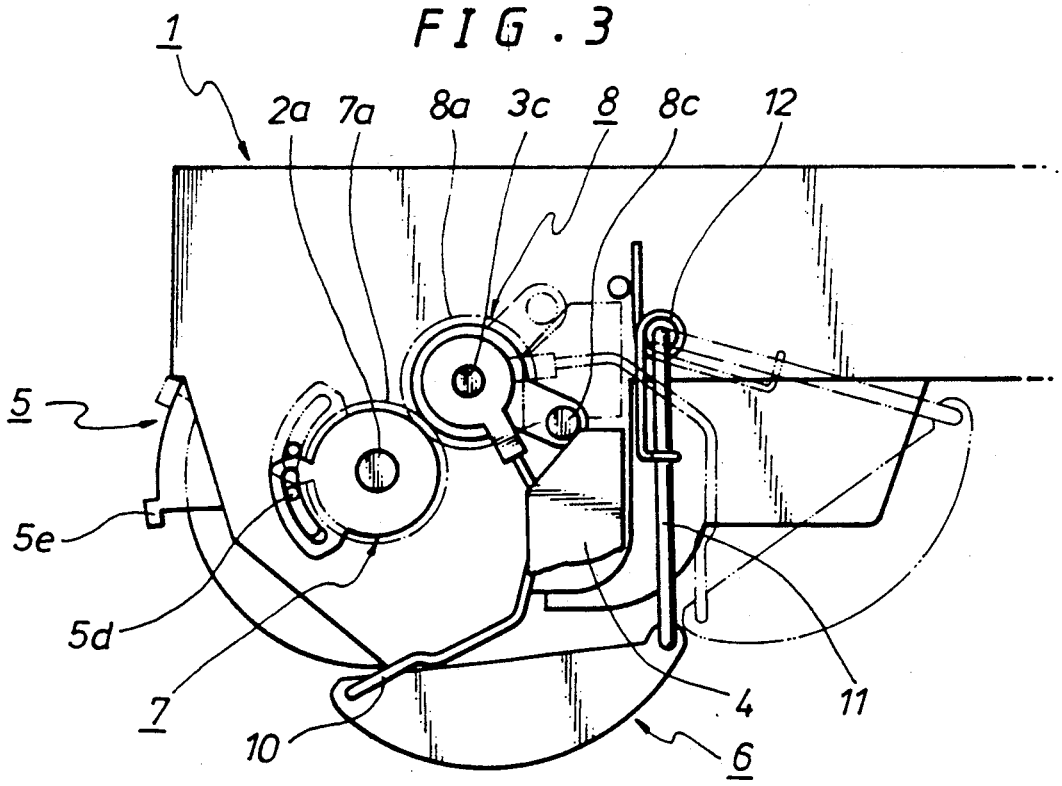
FIG. 3 is a partial side view showing the drum cartridge of FIG. 1 with the protective cover in the open position.

In FIG. 3, when the drum cartridge is mounted into the electrophotographic apparatus, the driving pin 8*c* of the second gear 8 comes in contact with the upper portion of the guide plane 4*a* of the protrusive piece 4. According to the operation, the second gear 8 becomes rotated in the counter-clockwise direction through the lever 8*b* by the driving pin 8*c*, then, the first gear 7 in mesh with the second gear 8 is clockwisely rotated.

By the aforesaid operation, the driven pin 5*d* of the upper cover 5 is upwardly driven by the side wall of the guide cam 7*c* formed in the extension 7*b* of the first gear in the clockwise direction, thereby making the upper cover 5 be opened.

Meanwhile, the lower cover 6 is opened by the first connecting rod 10 fitted into the extension 8*d* of the second gear 8. In more detail, the lower cover 6 which is begun to be opened in the position shown in FIG. 2 is moved toward the right direction of the drawing approximately in parallel linking motion including a little vertical displacement by the relative motion of the driving pin 8*c* and the guide plane 4*a*, as far as it reaches the intermediate position designated by solid line in FIG. 3. When the lower cover passes by the intermediate position, the driving pin 8*c* of the second gear 8 is upon further relative motion along the guide plane 4*a* of the protrusive piece 4. According to this operation, the lower cover 6 is moved to the position designated by dotted line by counter-clockwise rotation around the hinge boss 3*d* hingedly coupled to one end of the second connecting rod 11. Accordingly, almost the whole portion of the photosensitive drum 2 in the main body becomes externally exposed under the condition that the upper and the lower covers 5 and 6 are opened.

Figure 4A:
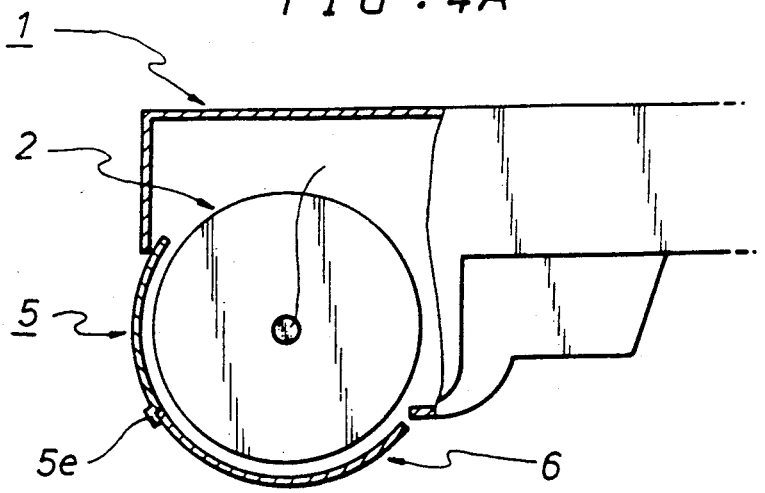
FIG. 4A is a schematic section view corresponding to the closed position shown in FIG. 2.
Figure 4B:
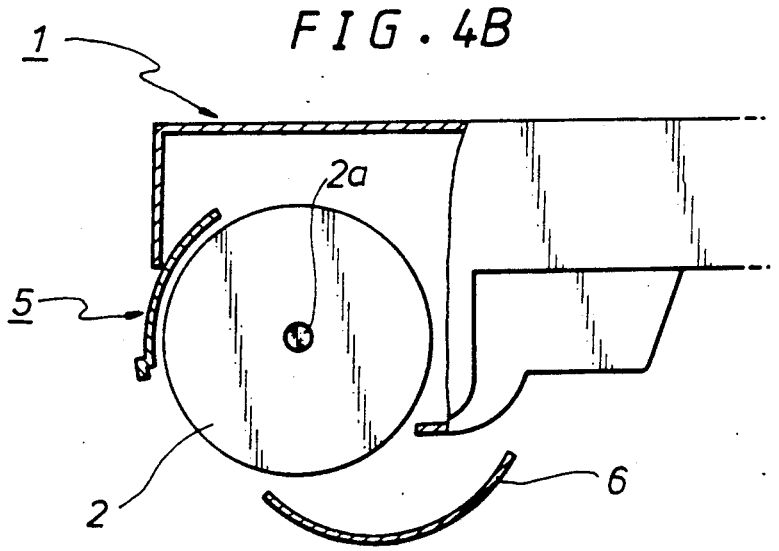
FIG. 4B is a schematic section view corresponding to the intermediate position designated by solid line in FIG. 3.
Figure 4C:
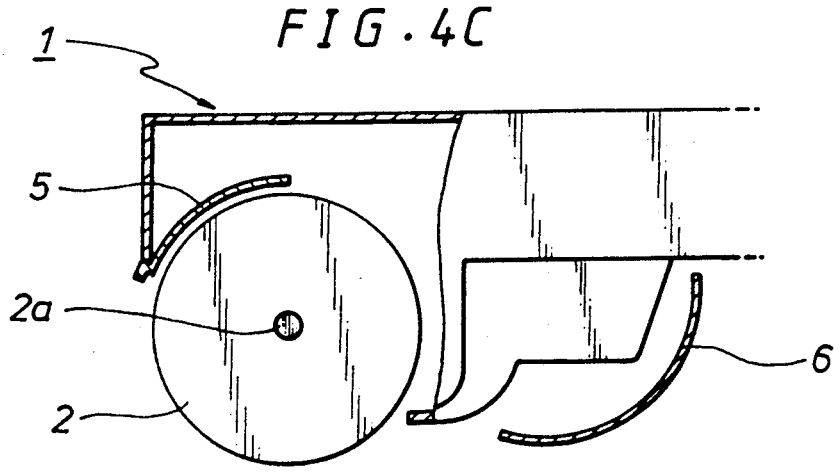
FIG. 4C is a schematic section view corresponding to the open position designated by dotted line in FIG. 3.

The movement of the protective cover and the exposure of the photosensitive drum are illustrated in FIGS. 4A to 4C. The operation for mounting the drum cartridge to the electrophotographic apparatus is performed by the cited order shown in FIGS. 4A to 4C, on the contrary, the operation for pulling out the drum cartridge from the eletrophotographic apparatus is performed in the reverse order. The specific operations during respective steps are identical to those described above, and, thus, the repeated description will be omitted.

According to the present invention as described above, the protective cover can be automatically opened and closed by the mounting and separating the drum cartridge. Furthermore, the photosensitive drum is completely exposed during the open position of the protective cover, consequently, it can be expected to enhance the space effectiveness and achieve high speed transfer. In addition, it is possible to completely protect the photosensitive drum during closed position of the protective cover with the result of sufficient prevention from deterioration, injure, or stain.

What is claimed is:

1. A drum cartridge with a two piece protective shutter covering the drum for an electrophotographic apparatus comprising:

a photosensitive drum rotatably supported by support brackets formed on both sides of a main body, and a part of said drum being exposed through an opening of said main body;

an upper shutter for covering a part of the opening and rotatably supported by a drum shaft of said photosensitive drum;

a lower shutter for covering the part of the opening not covered by said upper shutter;

a first connecting rod supporting said lower shutter and having a first end hingedly coupled to a first side of said lower shutter;

a first gear rotatably supported by said drum shaft for opening and closing said upper shutter;

a second gear engaging said first gear and having a driving pin for receiving a predetermined torque applied from outside, a portion of said second gear being fixedly coupled to a second end of said first connecting rod; and a second connecting rod supporting said lower shutter having a first end hingedly coupled to said support bracket and a second end hingedly coupled to a second side of said lower shutter.

2. A drum cartridge for an electrophotographic apparatus as claimed in claim 1 including a projection having a guide plane disposed on a side of said drum cartridge selectively contacting said driving pin for transmitting torque to said driving pin of said second gear.

3. A drum cartridge for an electrophotographic apparatus as claimed in claim 1 including a torsion spring for elastically biasing said second connecting rod to close said lower shutter.

4. A drum cartridge for an electrophotographic apparatus as claimed in claim 1 including an extension having a first guide cam disposed on said first gear, a second guide cam disposed on said support bracket, and a driving pin on said upper shutter accepted and guided by said first guide cam through said second guide cam.

5. A drum cartridge for an electrophotographic apparatus as claimed in claim 1 wherein said upper shutter includes an overlap abutment for covering an edge of the lower shutter when said upper and lower shutters are closed, thereby completely shielding said photosensitive drum from light.

6. A drum cartridge for electrophotographic apparatus with a two-piece protective shutter comprising:

a photosensitive drum having a drum shaft, a main body including an opening and sides, and support brackets disposed on opposite sides of said main body rotatably supporting said drum, a first part of said photosensitive drum being exposed through the opening of the main body;

a lower shutter for covering part of the opening, rotatable first and second connecting rods movably supporting said lower shutter, a first end of each said first and second connecting rods being hingedly coupled to a first side of said lower shutter and a second end of said second connecting rod being hingedly coupled to at least one of the support brackets;

an upper shutter for covering the part of the opening not covered by said lower shutter, said upper shutter being rotatably supported by said drum shaft;

a first gear rotatably supported by the drum shaft for opening and closing said upper shutter; and a second gear engaging said first gear and having a driving pin for receiving a predetermined torque applied from outside, a portion of said second gear fixedly coupled with a second end of said first connecting rod for opening and closing said lower cover.

7. A drum cartridge with a two piece protective shutter for an electrophotographic apparatus comprising:

a main body having an opening;

a photosensitive drum rotatably supported at opposite sides of said main body, at least a part of said photosensitive drum being exposed through the opening;

upper shutter means, movably supported by the drum shaft, for covering a part of the opening;

lower shutter means, movably supported by said main body, for covering the part of the opening not covered by said upper shutter means; and control means for receiving an external torque for moving said upper and lower shutters in opposite directions to expose said photosensitive drum.

8. A drum cartridge as recited in claim 7 wherein said upper shutter means includes a first gear, said lower shutter means includes a second gear engaging said first gear, and said control means causes at least one of the first and second gears to rotate.

* * * * *